United States Patent [19]

Fitzgerald et al.

[11] Patent Number: 4,724,999

[45] Date of Patent: Feb. 16, 1988

[54] SECURED MAILBOX

[76] Inventors: Norma J. Fitzgerald; Virgil K. Fitzgerald, both of 1893 Stonehenge Dr., Lafayette, Colo. 80026

[21] Appl. No.: 871,257

[22] Filed: Jun. 6, 1986

[51] Int. Cl.[4] ..... B65D 9/00

[52] U.S. Cl. ..... 232/17; 232/45

[58] Field of Search ..... 232/17, 43.1, 45, 38, 232/46, 47

[56] References Cited

U.S. PATENT DOCUMENTS

| | | | |
|---|---|---|---|
| 104,043 | 6/1870 | Marsh . | |
| 420,265 | 1/1890 | Bricker . | |
| 516,891 | 3/1894 | Hentz . | |
| 725,080 | 4/1903 | Henry . | |
| 1,506,646 | 8/1924 | Kolstad | 232/45 |
| 1,539,929 | 6/1925 | Arial | 232/45 |
| 2,428,509 | 7/1946 | Baker | 232/19 |
| 2,579,877 | 8/1949 | Stone | 232/27 |
| 3,401,875 | 11/1967 | Bruhns | 232/34 |
| 3,735,919 | 5/1973 | Morgan | 232/17 |
| 3,758,027 | 9/1973 | Morgan | 232/17 |
| 3,880,344 | 4/1975 | Earle | 232/17 |

*Primary Examiner*—Robert W. Gibson, Jr.
*Attorney, Agent, or Firm*—James R. Young

[57] ABSTRACT

A mailbox or receptacle for mail, newspapers, and the like, has two compartments: an unsecured upper compartment and a secure, locked lower compartment, with a partition between the two compartments. A door in the partition allows access to a chute extending downwardly from the upper into the lower compartment. The chute is set at angles which allow mail and papers to pass from the upper to the lower compartment, but prohibits arms or hands from extending into the lower compartment.

17 Claims, 6 Drawing Figures

SECURED MAILBOX

BACKGROUND OF THE INVENTION

I. FIELD OF THE INVENTION

The present invention relates to new and useful improvements to deposit and collection receptacles, such as mailboxes, and more specifically to a secure mailbox with a limited access storage compartment for the collection and secure retention of mail and other valuable documents.

II. DESCRIPTION OF THE PRIOR ART

Receptacles, such as mailboxes and other depositories for various items have been in use for many years with typical use involving the mounting of a mailbox along a roadway or into the wall of a home for delivery and pickup of mail. Typical conventional mailboxes that are readily accessible to delivery persons or pickup persons, are also generally accessible to unauthorized persons. Therefore, such conventional mailboxes leave a person's mail susceptible to theft, vandalism, and lack of privacy.

Also, when someone is away from home for several days or weeks, mail that is continually delivered on a daily basis accumulates in the person's mailbox. The accumulated mail not only jams conventional mailboxes, but also can provide a signal or sign to burglars and vandals that the person is away from home for an extend period, thus marking the person's home an easy target for a burglary or vandalism. While the person can request the Post Office personnel to withhold mail delivery or ask a neighbor to collect his mail during his absence, there are times when these solutions are impractical. For example, the person might leave on short notice or forget to make arrangements with the Post Office or a neighbor until the last minute before leaving when it might be after hours or too late or too inconvenient to make such arrangements. Also, such arrangements themselves can be a means of disseminating the information that the person is planning to be gone and the length of his absence, which information, through careless or unscrupulous postal employees or neighbors, can get to burglars or vandals.

It is often more desirable, therefore, to simply say nothing and allow mail, newspapers, and the like to accumulate during a short absence. In such situations, a mailbox having a locked storage compartment for mail to accumulate would be desirable. It would also be desirable to have the mail accumulate out of sight so that a potential burglar could not see the mail accumulation. Yet, when the person is home, he might prefer a normal mailbox for sending and receiving his mail.

A number of mailboxes have been made to provide security for the deposited items by having the items passed through a trap mechanism into a security area when the door is closed so that the items cannot be returned through the trap mechanism when the door is opened. Such arrangements have excessive mechanical parts that wear and break or are affected by moisture, ice, or snow and have been relatively expensive to manufacture and unreliable in use, thus limiting their successful uses. Similar attempts using trap mechanisms have had to provide methods attached to the flag to deflect the operation of the trap when mail was to be picked up by the postman, resulting in additional manufacturing costs. Many times the postman would first lower the flag and unknowingly deposit the mail to be picked up into the secured compartment. Also, many of the prior attempts only had small storage spaces with no provision for holding accumulated mail in a secured chamber while in the absence of the patron. Also prior attempts made no provisions to allow the use of the device as an ordinary unsecured mailbox with optional alternate use for secured retainment and storage of delivered items.

In summary, while there have been a number of prior attempts to solve the problems of providing a secure storage of mail or other items, there is still a substantial, unfulfilled need for an improved mailbox that is simple to operate, economical to produce, easy to gain access and pick up mail on a stationary shelf, secured to prevent theft, and has a large enough compartment for adequate storage of items accumulated out of sight for at least several days or weeks until they are collected. Yet, the mailbox must be accessible to the mail delivery person without keys or the necessity to open the locked compartment for delivery or pick up and which can be understood and used readily by any delivery person without prior instructions.

SUMMARY OF THE INVENTION

Accordingly, it is a general object of the present invention to provide a mailbox or receptacle for mail, newspapers, or other items that has a secure, locked storage compartment in which mail or other items deposited therein are out of sight and out of reach from the outside, yet which does not require a key or combination for a delivery person to deposit mail or other items therein.

It is a more specific object of this invention to provide such a mailbox that is also useable as a conventional mailbox for sending and receiving mail in a conventional manner if desired.

Another more specific object of this invention is to provide such a mailbox that has a sufficiently large locked storage compartment to hold securely several days or weeks accumulation of mail, yet has an overall size and appearance that is small enough to be economical and compatible in both appearance and use with other conventional roadside mailboxes.

Another specific object of this invention is to provide a mailbox that can be used as a conventional unsecured mailbox when it is closely attended and security is not a concern and which can be easily converted to a secure, locked mailbox without requiring the postal delivery person to have any special instructions or to make any significant changes in the way he delivers mail.

Additional objects, advantages, and novel features of the invention are set forth in part in the description that follows, and in part will become apparent to those skilled in the art upon examination of the following specification or may be learned by the practice of the invention. The objects and advantages of the invention may be realized and attained by means of the instrumentalities, combinations, and method particularly pointed out in the appended claims.

To achieve the foregoing and other objects and in accordance with the purposes of the present invention, as embodied and broadly described herein, the article and apparatus of this invention may comprise a housing enclosing an interior chamber that is substantially divided by a horizontal partition into an upper compartment and a lower compartment with an interior opening in the partition adjacent the front for a passage from the upper to the lower compartment. The housing has an upper door into the upper compartment and a lower door into the lower compartment. The lower door has a lock to secure the lower compartment against unauthorized access. A trap door in the upper compartment for closing the interior opening so that the upper compartment can be used as a conventional mailbox. Alternatively, the trap door can be opened to deflect mail inserted through the upper door downwardly through the interior opening into the locked lower compartment. An inclined chute extending rearwardly and downwardly from the front under the interior opening and under the partition is sized, shaped, and positioned to prevent visual contact with the contents in the lower compartment and to prevent reaching the contents with one's arm through the upper door and interior opening.

BRIEF DESCRIPTION OF THE DRAWINGS

The accompanying drawings, which are incorporated, in and form a part of, the specifications illustrate the preferred embodiments of the present invention, and together with the description serve to explain the principles of the invention.

In the drawings.

DESCRIPTION OF THE PREFERRED EMBODIMENTS

Figure 1:
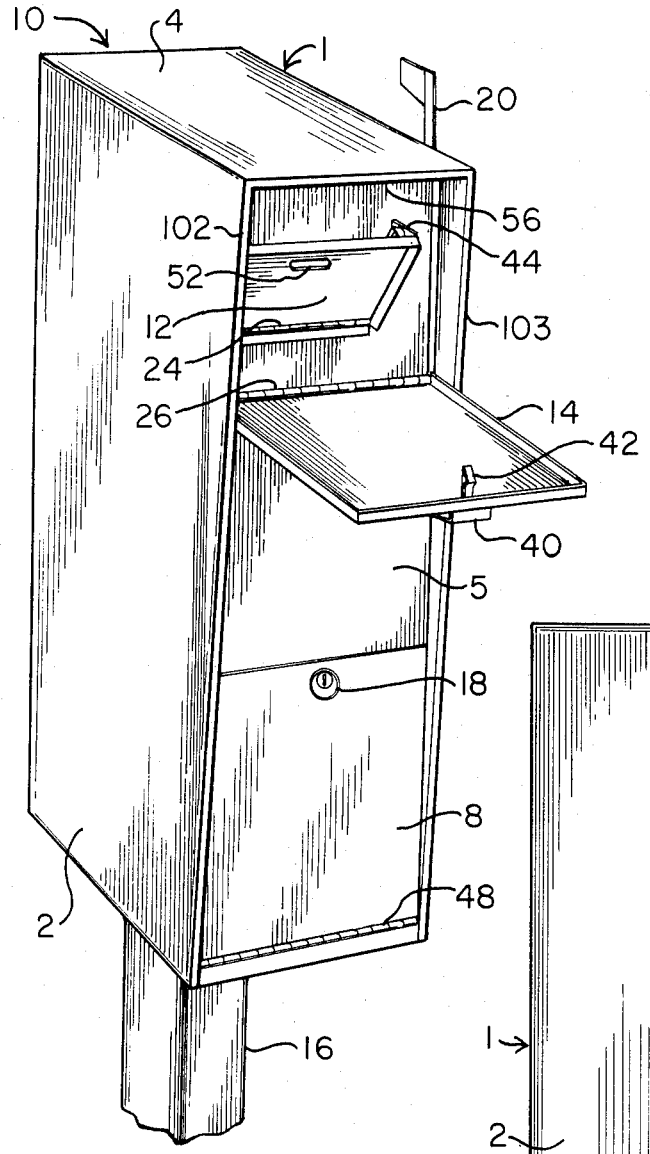
FIG. 1 is a perspective view of the mailbox of the present invention illustrated with an external door to an upper compartment in open position and an external door to a lower compartment in closed position and an internal door between the upper and lower compartments in open position.
Figure 3:
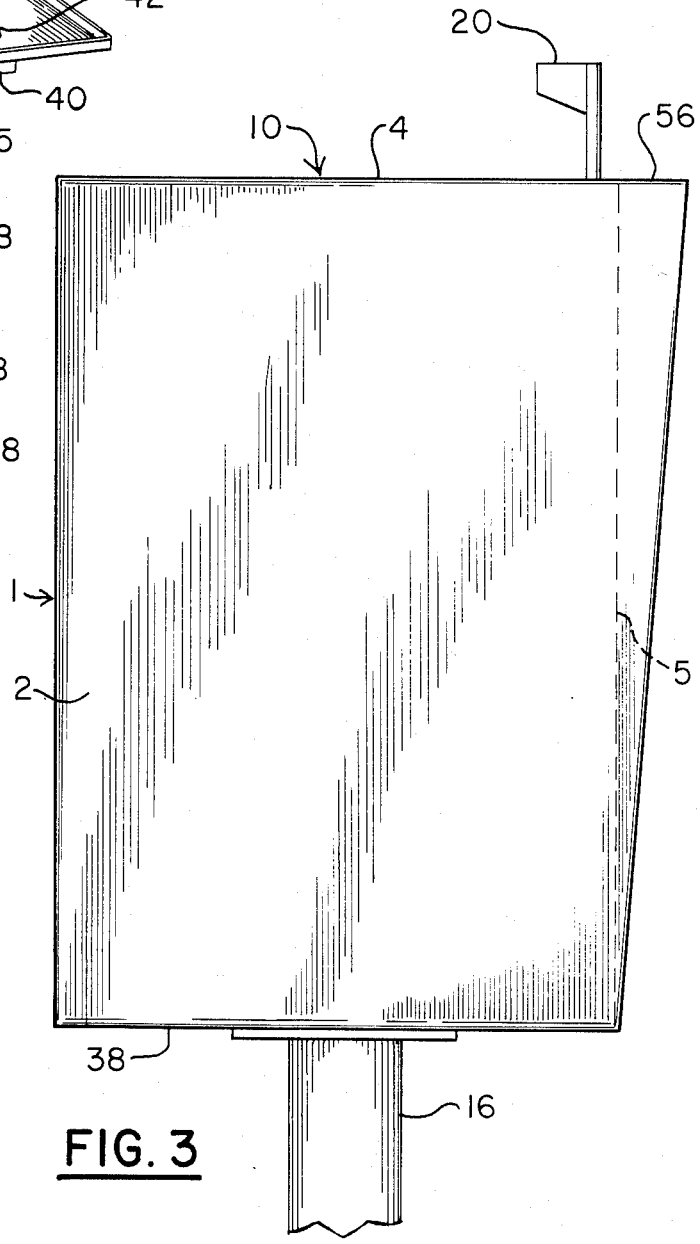
FIG. 3 is a side elevation view of the mailbox in FIG. 1 with a broken line illustrating the front face of the mailbox recessed under a canopy ledge to shelter it from the weather.
Figure 2:
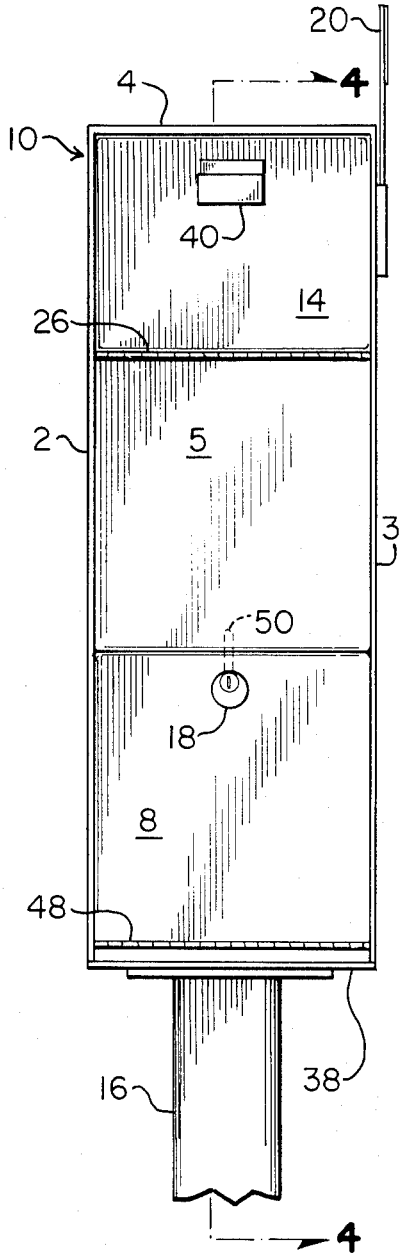
FIG. 2 is a front elevation view of the mailbox in FIG. 1 with the upper and lower compartment access doors in their closed positions.

The mailbox 10, of the present invention is illustrated in FIGS. 1 through 3 as substantially rectangular solid housing 1 mounted on a vertical post of pedestal 16. The lateral sidewalls or panels 2, 3, respectively, are elongated slightly trapezoidal sheets spaced apart to form an interior chamber enclosed by a rectangular top panel 4, bottom panel 8, rear panel 6, and front panel 5.

Figure 4:
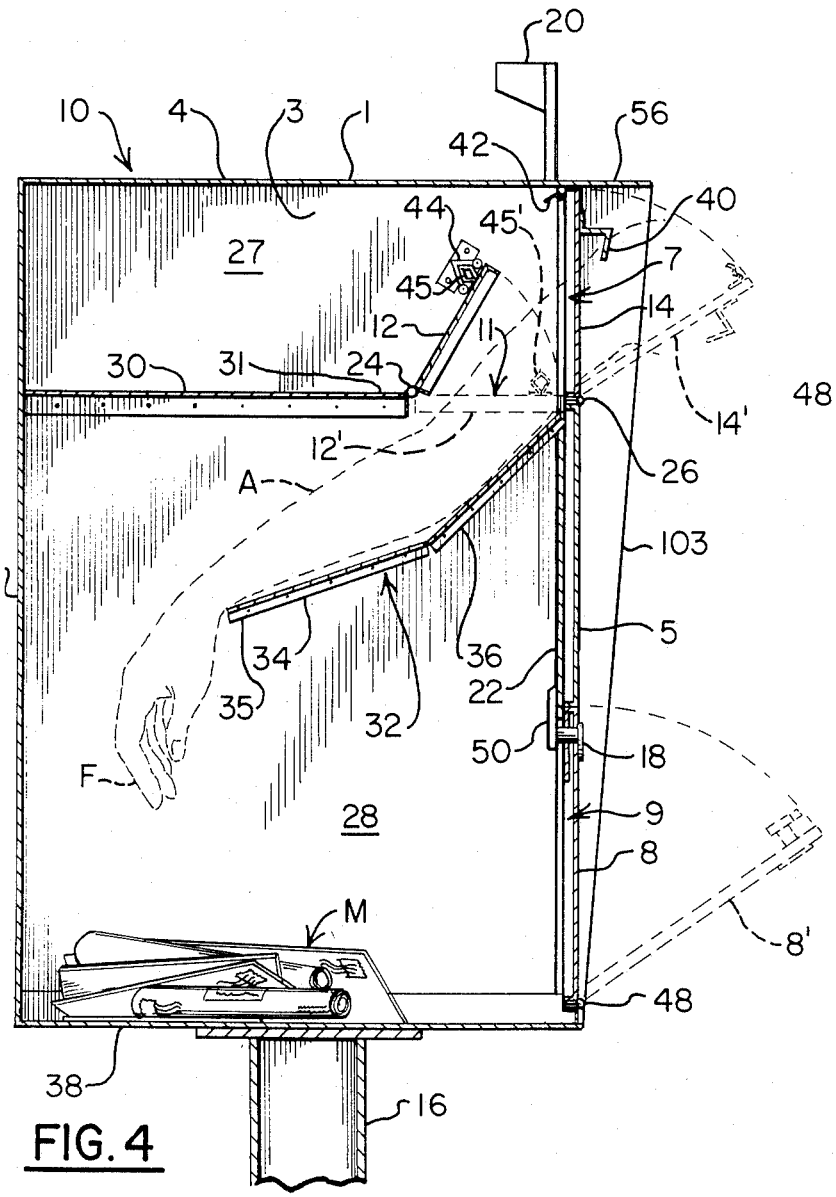
FIG. 4 is a cross sectional view of the mailbox taken substantially upon a plane passing through section line 4—4 of FIG. 2 illustrating the preferred interior structure of the mailbox and showing a person's arm in phantom lines trying unsuccessfully to reach over the distal end of the chute to grasp the mail in the lower compartment.

Referring now to FIG. 4, the interior chamber is divided into an upper compartment 27 and a lower compartment 28 by a horizontal partition or shelf 30. The shelf 30 extends from the rear panel 6 part way across the interior chamber to a front edge 31 positioned a spaced distance inwardly from the front panel 5. The trap door 12 is pivotally mounted on hinge 24 to the front edge 31 of shelf 30 and extends from the front edge 31 to the proximity of the front panel 5. The trap door 12 is illustrated in FIG. 4 in the open position, but it can be pivotally moved to the closed position illustrated by the broken lines 12'. In this closed position, the top surface of the trap door 12 forms an extension of the shelf 30 to the front panel 5 of the mailbox 10.

Also as shown in FIGS. 1 through 4, the front panel 5 has an upper opening 7 into the upper compartment 27, and a lower opening 9 into the lower compartment 28. An upper door 14 pivotally attached by hinge 26 to front panel 5 covers upper opening 7. A resilient releasable latch 42 holds upper door 14 in closed position. A lower door 8 pivotally attached by hinge 48 covers lower opening 9. The lower door 8 is equipped with a key-actuated lock mechanism 18 having a lock arm 50 for securing the door 8 in closed position.

The mailbox 10 according to this invention is intended to allow a user to utilize the upper compartment 27 as he would a conventional unlocked mailbox in which mail can be received or sent according to the conventional practice of the U.S. Postal Department. Specifically, with the trap door 12 in the closed position illustrated at 12', a mail delivery person can open door 14 and deposit a person's mail into the upper compartment 27. The owner of the mailbox 10 can retrieve his mail from the upper compartment 27 in the conventional manner by merely opening door 14 and reaching through upper opening 7 to access his mail. Also, if the owner of the mailbox wants to send mail, he can leave the mail to be sent on partition or shelf 30 in the upper compartment 27 and raise the flag 20 in the conventional practice to notify the mail delivery person that the mail left in upper compartment 27 is intended to be taken for deposit in the United States Postal Service.

Alternatively, when the mailbox owner prefers to have his mail handled and stored in a more secure manner, he can merely open the trap door 12, thereby allowing his mail that is inserted through the opening 7 to be dropped into the lower compartment 28. Since lower compartment 28 is accessible only through the locked door 8, only authorized persons having the appropriate key for lock mechanism 18 can gain access to the mail M deposited therein.

A significant feature of this invention as best illustrated in FIG. 4 is the unique security enhancement for the lower compartment 28 provided by the combination of the inclined chute 32, shelf 30, and trap door 12. When it is desired to utilize the lower compartment 28, as described above, the trap door 12 is pivoted about hinge 24 to the open position. It is retained in open position by a latch 44 mounted on the interior surface of the side panel 3, which is adapted to engage and releasably retain pin element 45 mounted on the top surface of the door 12. In this open position, mail inserted through opening 7 by the postal delivery person is automatically deflected downwardly through the opening 11 and into the lower compartment 28. Therefore, no special instructions or different actions of the part of the postal delivery person are required. The owner of the box merely has to open the trap door 12 to the position shown in FIG. 4, and the mail inserted through opening 7 will automatically be deposited in the lower compartment 28 instead of into the upper compartment 27.

The inclined chute 38 extends downwardly and rearwardly from the front panel 22 toward the rear panel 6. It is preferably comprised of two connected sections. A steeper inclined section 36 extends downwardly from its proximal end adjacent the opening 7 in front panel 22. A second section 34 extends from the section 36 at a lesser incline to a distal end 35. The junction between the upper section 36 and the lower section 34 of inclined chute 32 is positioned under the distal end 31 of shelf 30 a distance approximately equal to the distance between distal end 31 and the front panel 22. The distal end 35 of lower section 34 is spaced inwardly from the rear panel 6 a distance approximately equal to the distance between the distal end 35 and the shelf 30, which distance is preferably just sufficient to allow normal sized magazines and large envelopes to fall between the distal end 35 and the rear wall 6. Further, the distance between the distal end 31 of shelf 30 and the distal end 35 of chute 32 is approximately equal to the distance between an adult's elbow and wrist. Also, the distance between the distal end 35 of chute 32 and the floor 38 of compartment 28 is greater than the distance from an average person's wrist to his fingertips, and is preferably at least twice that distance.

With this structure and arrangement of components, mail inserted through opening 7 with the door 12 in the open position, as shown in FIG. 4 is dropped through the interior opening 11 onto chute 32 where it is guided toward the rear of compartment 28. As the mail M clears the distal end 35 of chute 32, it drops to the floor 38 of compartment 28. As further illustrated in FIG. 4, a person's arm A inserted through openings 7 and 11 and over chute 32 is limited to the extent to which his fingers F can reach downwardly into compartment 28. That distance is generally limited to the distance between the person's wrist extending over the distal end 35 of chute 32 downwardly toward the mail M, as shown in FIG. 4. Even if a person could extend his arm further into the compartment 28 before being stopped by his shoulder or armpit contacting the exterior surface 5, the angle of the unbendable forearm portion of his arm A could not be changed due to the limitations imposed by chute 32 and by the distal end 31 of shelf 30. Therefore, the downward distance that a person's fingers F could reach is still effectively limited by the distal end 35 of chute 32. With the preferable distance between the distal end 35 of chute 32 and the floor of 38 of compartment 28 being approximately twice the length of a person's hand, a substantial amount of mail M can accumulate in the compartment 28 before it could be reached by an intruder's arm, as shown in FIG. 4. Therefore, the mail M in lower compartment 28 can only be accessed by an authorized person through the locked door 8.

While the special relationships described above are not absolute, it has been found that these special relationships provide a mailbox having exterior dimensions and shape that are generally efficient and acceptable from both an economic and aesthetic standpoint, while still providing sufficient storage capacity and compartment 28 to be effective for at least several days storage of an average person's normal quantity of mail delivery, while providing an effective measure of security and simplicity of use.

As mentioned briefly above, the upper door 14 is preferably hinged at the bottom 26 to front facial plate or panel 5 and is adapted to swing outwardly and downwardly to open, as illustrated by the broken lines 14'. A handle 40 facilitates opening and closing the door 14, and a latch 42 at the distal end of the door 14 releasably secures it in closed position. The top panel 4 of the housing 1 preferably extends forwardly from the front facia or panel 5 a sufficient distance to form a forwardly projecting canopy or ledge 56 to shield the door 14 and opening 7 from rain, snow, and ice. A front edges 102, 103 of side panels 2 and 3, respectively, also extend forwardly of the front facia 5 to meet the outer end 56 of top panel 4 and then taper downwardly and inwardly to meet the bottom panel for floor 38.

Bottom door 8 is also preferably pivotally attached at its bottom proximal end by hinge 48 to the front panel 22 so that it opens outwardly and downwardly as indicated at 8'. In the closed and locked position, the lock finger 50 can be turned by an appropriate key in lock apparatus 18 to engage the inside surface of front panel 22, thereby prohibiting the door 8 from being opened without the proper key.

DETAILED DESCRIPTION OF THE ALTERNATE EMBODIMENT

Figure 5:
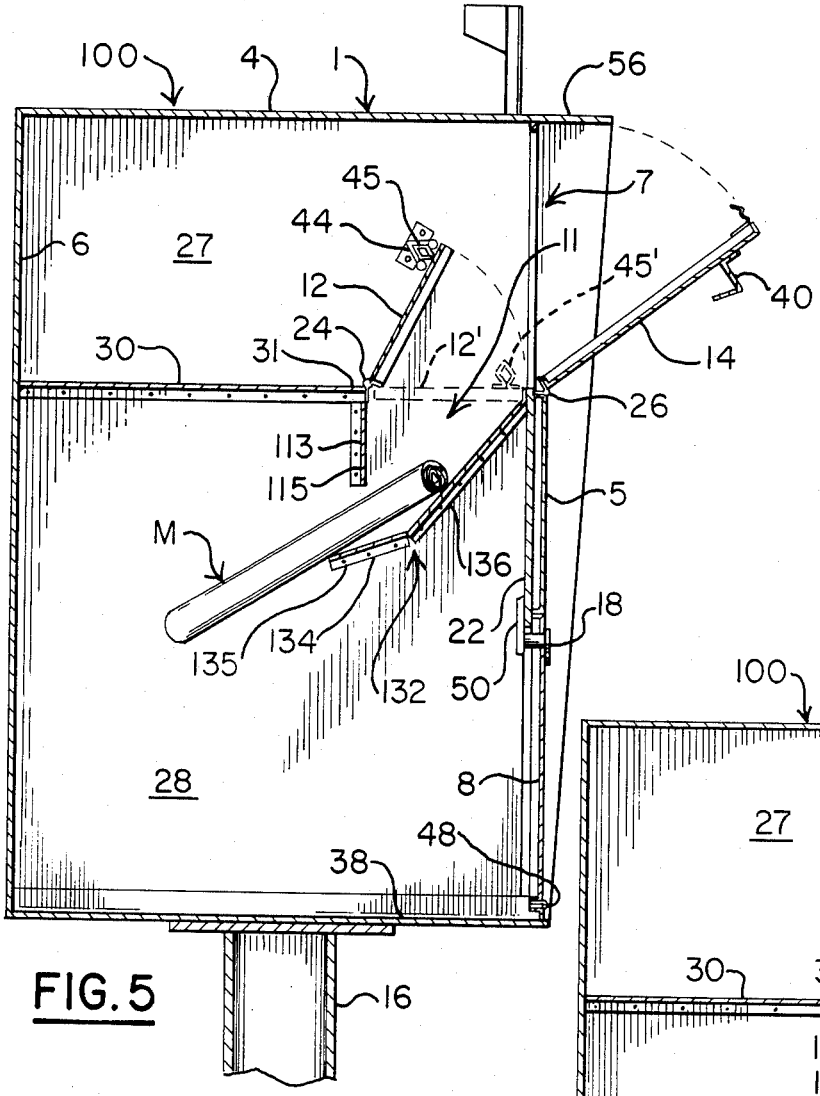
FIG. 5 is a cross-sectional view of an alternate embodiment of the present invention taken along line 4—4 of FIG. 2.
Figure 6:
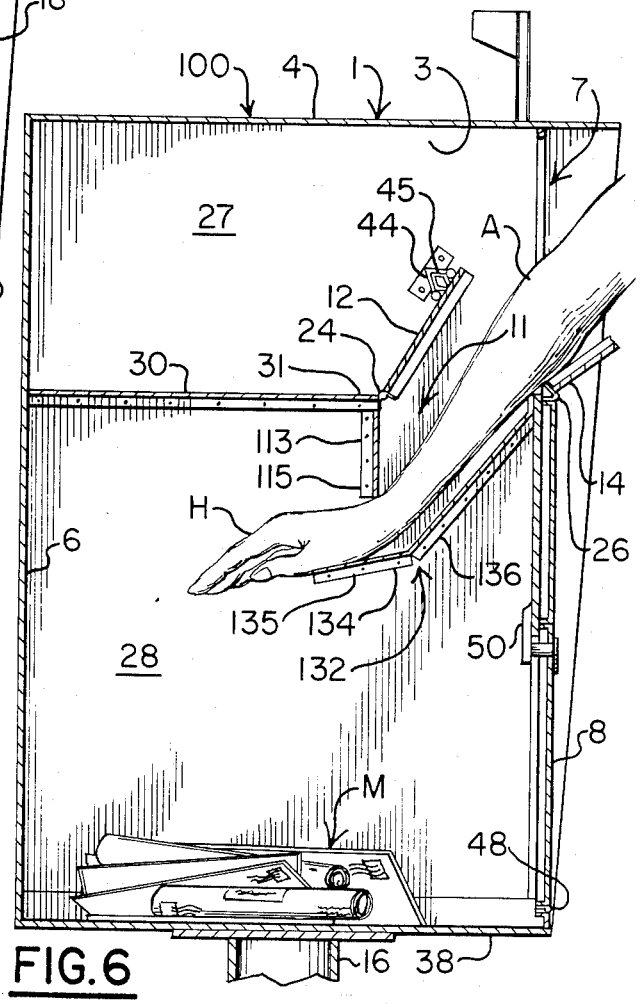
FIG. 6 is a cross-sectional view of the alternate embodiment of the present invention similar to view in FIG. 5 illustrating a person's hand unable to reach the mail in the locked lower compartment.

An alternate embodiment 100 of the mailbox according to the present invention is shown in FIGS. 5 and 6 and is quite similar to the preferred embodiment 10 described above. However, chute 132 in this alternate embodiment 100 is shorter to accommodate larger envelopes, newspapers, small packages P, and the like. Therefore, in order to maintain an acceptable level of security in this embodiment 100, the chute 132 is combined with a flange 113 that extends downwardly from the front edge 31 of shelf 30 and is rigidly attached to housing sides 2 and 3, respectively. Again the chute 132 is preferably comprised of two panels 134, 136, positioned at an obtuse angle to each other whereby a person's arm A is unable to pass through the opening formed between the bottom edge 115 of flange 113 and the lower chute panel 134.

As shown in FIG. 5, the structure of this alternate embodiment 100, similar to the preferred embodiment 10 described above, has an enclosed interior chamber divided into an upper compartment 27 and a lower compartment 28 by a horizontal shelf 30 extending from the rear panel 6 toward the front panel 5. A trap door 12 selectively closes the interior opening 11, as indicated as 12'.

The chute 136 has a first section 136 that extends downwardly and inwardly from the bottom of opening 7 and is joined by a second section 134 that continues the extension of chute 132 downwardly and inwardly, albeit at less slope than section 136. Therefore, the top surfaces of the sections 136, 134 are at an obtuse angle to each other, and the second section 134 is positioned a spaced distance under the distal end 31 of shelf 30.

The flange 113 extends downwardly a spaced distance from the distal end 31 of shelf 30 toward chute section 134. The bottom or distal end 115 of the flange 113 terminates a spaced distance above chute section 134. The distance between the distal end 115 of flange 113 and the chute section 134 is such that a person's arm A cannot extend in a straight line through the opening 11 and past the distal end 135 of chute 132 into lower compartment 28. Therefore, as shown in FIG. 6, the chute section 134 in combination with flange 113, the bottom of opening 7, and chute section 136 force the intruder's wrist into a reverse bend with the palm of the hand H pressed against chute section 134 at approximately the same slope as chute section 134. Since the person's forearm A cannot bend, it cannot be inserted any further into lower compartment 28. Therefore, the maximum insertion of a normal person's hand H is with the palm laying in approximately the same plane as the surface of chute section 134, as shown in FIG. 6, so that the person's fingers cannot extend downwardly toward the mail M accumulating on the floor 38 of lower compartment 28. Consequently, this embodiment 100 is more conducive to either a smaller mailbox with a more shallow storage compartment 28 than that shown in the preferred embodiment 10 or to a greater accumulation of mail in compartment 28 than is possible in the preferred embodiment 10. Yet, because there is substantially more space between the distal end 135 of chute 132 and between the distal end 135 and the shelf 30, this alternate embodiment 100 can accommodate larger envelopes, packages, newspapers, and the like, than the preferred embodiment 10 described above.

SUMMARY OF DETAILED DESCRIPTION

The components and structures of the mailbox embodiments 10 and 100 described above are preferably fabricated substantially of thin sheets of relatively strong materials, such as sheet metal, fiberglass, plastics, wood, or the like. While actual dimensions can vary within a reasonable range and still provide the desired effects of security and storage for delivered mail, for purposes of economics, functionality, practicality, aesthetics, and conforming to conventional U.S. Postal Service practices, there are preferred size range. For example, the housing 1 is preferably in the range of 15 to 25 inches long, 20 to 40 inches high, and 5 to 15 inches wide. The shelf 30 is preferably about 8 to 16 inches long, leaving an interior opening 11 about 3 to 8 inches between the front panel 22 and the shelf 30.

The foregoing description is considered as illustrative only of the principles of the invention. Further, since numerous modifications and changes will readily occur to those skilled in the art, it is not desired to limit the invention to the exact construction and processes shown and described above. Accordingly, all suitable modifications and equivalents may be resorted to falling within the scope of the invention as defined by the claims which follows.

The embodiments of the invention in which an exclusive property or privilege is claimed are defined as follows:

1. Mailbox and depository receptacle apparatus, comprising:

a housing enclosing an interior chamber, said housing including a bottom panel and a top panel spaced apart vertically from each other, two spaced apart side panels extending respectively between opposite lateral sides of said top and bottom panels, a back panel extending between the respective rear edges of the top, bottom, and lateral side panels, and a front panel extending between the respective front edges of the top, bottom, and lateral side panels;

an interior horizontal partition positioned between the lateral side panels and extending from the back panel forwardly toward the front panel to effectively divide said interior chamber into an upper compartment above the partition and a lower compartment below the partition, said upper and lower compartments being joined by an interior opening between the front panel and the front edge of the partition;

interior closure means positioned adjacent said partition for selectively opening and closing said interior opening;

said front panel having an upper access opening therethrough in alignment with said upper compartment and upper closure means on said front panel for selectively opening and closing said upper access opening;

one of said panels other than the top panel having a lower access opening therethrough in alignment with said lower compartment and lower closure means on said one panel for selectively opening and closing said lower closure means;

chute means extending at a downward slope from its proximal end adjacent said front panel under said upper opening and under said interior opening toward said back panel to its distal end positioned a spaced distance under said partition, a spaced distance inwardly from said rear panel, and a spaced distance above said bottom panel.

2. The apparatus of claim 1, wherein said interior closure means includes an interior door panel pivotally attached to the front edge of said partition and is pivotal to a closed position over said interior opening, in which position said interior door panel effectively extends said partition to said front panel.

3. The apparatus of claim 2, wherein said interior door is pivotal to an open position extending upwardly from the front edge of said partition to a position in horizontal alignment with the central portion of said upper opening to thereby effectively block the portion of said upper compartment above said partition to access from said upper opening.

4. The apparatus of claim 3, including latch means on said interior door for releasably securing said interior door in said open position.

5. The apparatus of claim 3, wherein said lower closure means includes lockable latch means for securing said lower compartment from unauthorized access.

6. The apparatus of claim 1, wherein said chute means has a surface under said internal opening and under said partition extending between the proximal and distal ends of the chute, and wherein said surface has a point between said proximal and distal ends where it is displaced downwardly from a flat plane that extends through said proximal and distal ends.

7. The apparatus of claim 6, wherein the downward slope of said surface of said chute near the proximal end is steeper than the downward slope of said chute near the distal end.

8. The apparatus of claim 7, wherein said surface has a first planar section adjacent extending downwardly from the proximal end and a second planar section extending from the first section to the distal end and wherein a point of maximum displacement of said surface from said plane extending through the proximal and distal ends is positioned at the intersection of said first and second planar sections such that said first and second planar sections have an obtuse angle between them.

9. The apparatus of claim 8, wherein said obtuse angle is in the range of about 120° to 170°.

10. The apparatus of claim 9, wherein said maximum displacement is in the range of about 1 to 3 inches.

11. The apparatus of claim 6, wherein said chute surface extends a sufficient distance toward said back panel that it intersects a straight line extending through said upper and inner openings to said bottom panel, whereby there is no direct line of sight through said upper and inner openings to the bottom of said lower compartment.

12. The apparatus of claim 11, wherein the point on said surface of maximum displacement from said flat plane is positioned generally under said inner opening.

13. The apparatus of claim 12, wherein a vertical line extending through said point of maximum displacement does not intersect said partition.

14. The apparatus of claim 8, wherein said second planar section extends rearwardly from a vertical line extending through the front edge of said partition a distance at least half as long as a person's forearm and terminates at its distal end a distance above said bottom panel greater than the length of a person's hand.

15. The apparatus of claim 14, wherein the distance between the proximal and distal ends of the chute is greater than the length of a person's forearm and the distal end is far enough above the bottom panel that a person's hand cannot reach the bottom of said lower compartment with his arm extending through said upper and inner openings.

16. The apparatus of claim 8, including a flange extending downwardly from said partition a sufficient distance to intersect a line extending parallel to the plane of said first planar section and through the distal end of said second planar section.

17. The apparatus of claim 6, including a point on said surface where displacement from said flat plane is at a maximum, and a flange extending downward from said partition a distance sufficient to intersect a line that extends through said distal end and parallel to a flat plane that is parallel to the front edge of the partition and passes through both the bottom of said upper opening and the point of maximum displacement.

* * * * *